United States Patent [19]

Pasternack

[11] 4,301,792

[45] * Nov. 24, 1981

[54] RESPIRATOR WITH COOLING DEVICE

[75] Inventor: Adalbert Pasternack, Bad Schwartau, Fed. Rep. of Germany

[73] Assignee: Drägerwerk Aktiengesellschaft, Fed. Rep. of Germany

[ * ] Notice: The portion of the term of this patent subsequent to Feb. 19, 1997, has been disclaimed.

[21] Appl. No.: 92,190

[22] Filed: Nov. 7, 1979

[30] Foreign Application Priority Data

Dec. 15, 1978 [DE] Fed. Rep. of Germany ..... 2854166

[51] Int. Cl.[3] ..... A62B 7/00

[52] U.S. Cl. ..... 128/202.26; 128/204.15; 128/205.12

[58] Field of Search ..... 128/202.26, 204.15, 128/205.22, 402, 202.19, 205.12

[56] References Cited

U.S. PATENT DOCUMENTS 4,188,947 2/1980 Pasternack ..... 128/204.15 X

FOREIGN PATENT DOCUMENTS 1301725 8/1969 Fed. Rep. of Germany ..... 128/204.15

*Primary Examiner*—Henry J. Recla

*Attorney, Agent, or Firm*—McGlew and Tuttle

[57] ABSTRACT

An improved portable respirator adapted to be worn on the back of a user of the type having a housing for housing a cartridge means containing a chemical which fixes carbon dioxide or evolves oxygen or both and an air bag includes a support frame having an integral compartment adapted to be charged with a coolant for cooling respiratory air.

2 Claims, 1 Drawing Figure

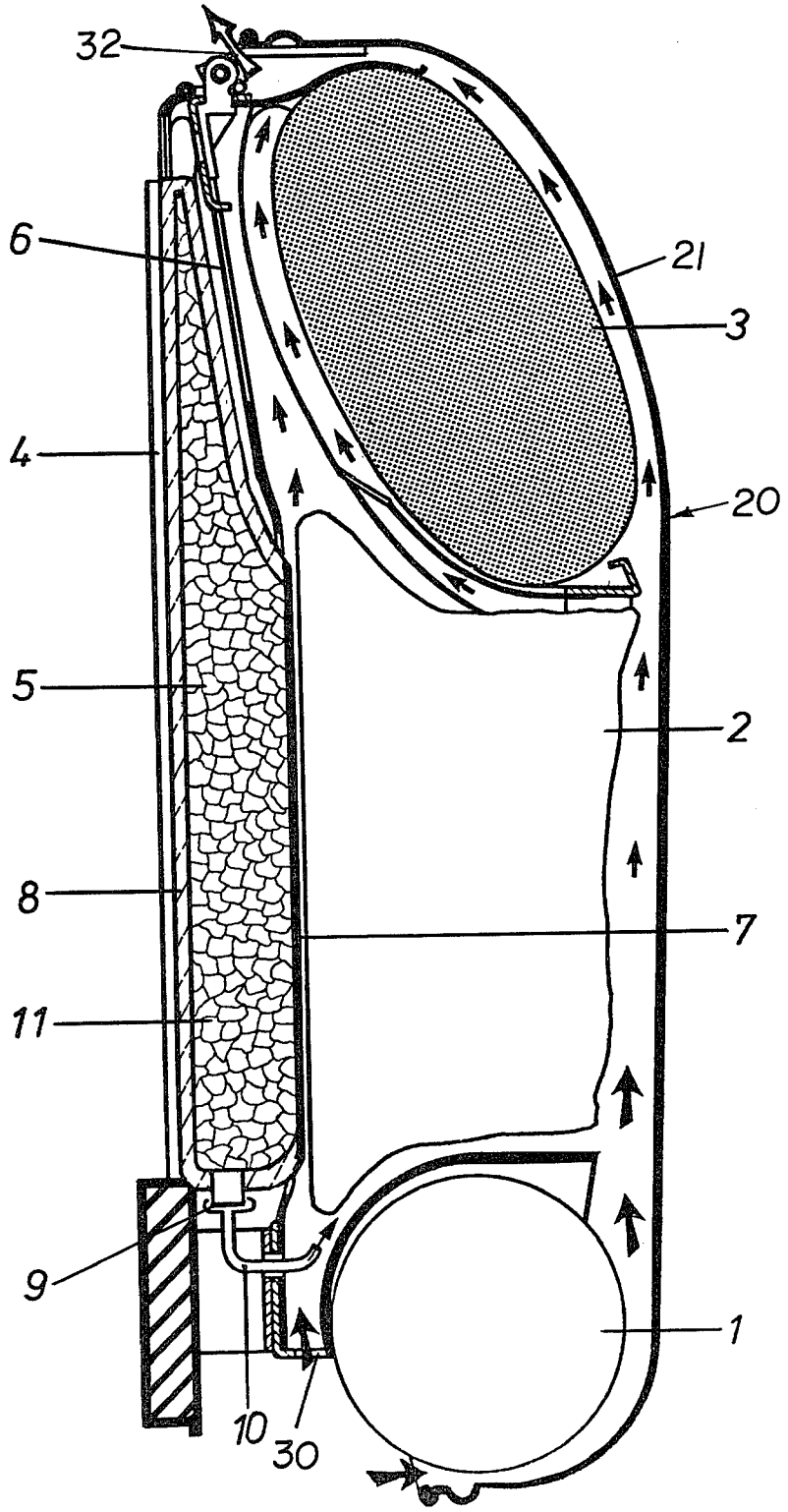
32
6
21
3
4
20
5
2
8
7
11
9
1
10
30

RESPIRATOR WITH COOLING DEVICE

FIELD AND BACKGROUND OF THE INVENTION

This invention relates to respirators in general and, more particularly, to an improved cooling arrangement for a breathing apparatus having a chemical cartridge for the absorption of exhaled carbon dioxide or the development of oxygen or both.

This invention relates to improvements in the respirator as disclosed in co-pending U.S. application Ser. No. 866,238 filed on Jan. 3, 1978 now U.S. Pat. No. 4,188,947, issued Feb. 19, 1980, the disclosure of which is hereby incorporated by reference. In a respirator of the type so disclosed, a chemical cartridge for the absorption of exhaled carbon dioxide or the evolution of oxygen or both is provided with a coolant-containing cooling device, i.e. a coolant bag.

The coolant is contained in the coolant bag which is arranged in a space between a contact wall to an air bag and the back of the respirator support structure. The coolant bag can be surrounded by an insulating layer, with the exception of the contact surface to the contact wall. On its bottom, the coolant bag has a filler cap with a closure. The coolant is preferably dry ice.

SUMMARY OF THE INVENTION

In accordance with the invention, the need for a separate coolant bag is eliminated and the coolant is integrally arranged directly in the supporting construction without any additional cover. A tight bearing, which enhances intensive cooling, is achieved by designing the back bracing as an elastic wall.

It is an object of the invention to provide an improved respirator adapted to be worn on the back of a user of the type having a housing for housing cartridge means containing a chemical which fixes carbon dioxide or evolves oxygen or both and which also houses an air bag, which includes in accordance with the invention in combination, a support frame connected to the housing, the support frame having all means defining a compartment adapted to be charged with a coolant, the wall means including an elastic wall portion and a contact wall spaced from the elastic wall portion, and the contact wall being disposed to bear against the air bag. Means are provided for introducing the coolant into the compartment.

It is a further object of the invention to provide a respirator in which the wall means is lined with an insulating layer except for the contact wall portion.

It is a further object of the invention to provide an improved respirator which is rugged in construction, simple in design and economical to manufacture.

The various features of novelty which characterize the invention are pointed out with particularity in the claims annexed to and forming a part of this disclosure.

For a better understanding of the invention, its operating advantages and specific objects attained by its uses, reference is made to the accompanying drawings and descriptive manner in which a preferred embodiment of the invention is illustrated.

BRIEF DESCRIPTION OF THE DRAWING

The sole FIGURE is a vertical sectional view of a respirator constructed in accordance with the invention.

DETAILED DESCRIPTION OF THE PREFERRED EMBODIMENT

Referring now to the sole FIGURE in detail, the invention embodied therein comprises a respirator 20 which is adapted to be worn on the back of a user which includes a cartridge 3 filled with a chemical which fixes a carbon dioxide or a chemical which simultaneously evolves oxygen and fixes carbon dioxide, as well as an air bag 2 and an oxygen cylinder 1. These components are arranged in a housing which is carried on the back of the user.

The respirator 20 includes a support frame 6 having a portion with a back bearing elastic wall 4 and a contact wall 7 disposed to bear against at least part of the air bag 2. Contact wall 7 is composed of a good heat conducting material. A coolant compartment 11, for containing a coolant 5 that cools the respiratory air, is formed adjacent the cartridge 3 and the air bag 2 by the cooperation of a side wall (not shown) of the support frame 6, the contact wall 7 and the elastic wall 4.

Respiratory air enters the housing 21 through an inlet 30 is at least partly circulated through the breathing or air bag 2, passes over the chemical cartridge 3 which adds oxygen or fixes carbon dioxide or both, and is discharged via an outlet 32.

In order to reduce the temperature of the air, the coolant 5 is confined in compartment 11. The coolant may be dry ice, water ice or any other known coolant.

In order to prevent cold losses and possibly supercooling of the body, the walls of compartment 11 are lined with an insulating layer 8, with the exception of contact wall 7. If dry ice is used as a coolant, the bottom of compartment 11 contains a filler cap 9, which is closed with a plug provided with a gas offtake 10.

While a specific embodiment of the invention has been shown and described in detail to illustrate the application of the principles of the invention, it will be understood that the invention may be embodied otherwise without departing from such principles.

What is claimed is:

1. An improved portable respirator adapted to be worn on the back of a user of the type having a housing, and cartridge means for containing a chemical mounted in the housing which fixes carbon dioxide or evolves oxygen or both, and an air bag mounted in the housing, comprising, in combination, a support frame integrally connected to the housing, said support frame having wall means defining a compartment adapted to be charged with a coolant, said wall means including an elastic wall portion adapted to bear against the back of the user and a contact wall of heat conducting material spaced from said wall portion, said contact wall being disposed to tightly bear against the air bag responsive to the bearing of said elastic wall portion on the user's back, means for introducing the coolant into said compartment, an insulating layer, said insulating layer being disposed in contact with said wall means except for said contact wall, and said housing having an air inlet and breathing passage means extending from said air inlet into and out of said bag and around the exterior portion of said bag not bearing against said contact wall and around the exterior of said cartridge to a person for respiration.

2. The improved respirator of claim 1, wherein at least part of said compartment is disposed adjacent to the cartridge means.

* * * * *